US007287554B2

(12) United States Patent
Mathews

(10) Patent No.: US 7,287,554 B2
(45) Date of Patent: Oct. 30, 2007

(54) HEALD, PARTICULARLY FOR RAPIDLY RUNNING WEAVING MACHINES

(75) Inventor: Oliver Hans Mathews, Stäfa (CH)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 11/485,421

(22) Filed: Jul. 13, 2006

(65) Prior Publication Data

US 2007/0028985 A1 Feb. 8, 2007

(30) Foreign Application Priority Data

Jul. 13, 2005 (DE) ..... 10 2005 033 175

(51) Int. Cl.
*D03C 9/02* (2006.01)
*D03C 9/04* (2006.01)
*D03C 7/06* (2006.01)

(52) U.S. Cl. ..... 139/93; 139/51; 139/52; 139/53; 139/94; 139/95

(58) Field of Classification Search ..... 139/51–53, 139/93–96
See application file for complete search history.

(56) References Cited

U.S. PATENT DOCUMENTS 1,341,244 A * 5/1920 Ruegg, Jr. ..... 139/93
1,341,245 A * 5/1920 Ruegg, Jr. ..... 139/96
1,379,824 A * 5/1921 Kaufmann ..... 139/96
1,399,237 A * 12/1921 Zipfel ..... 139/95
RE15,509 E * 12/1922 Ruegg, Jr. ..... 139/93
1,517,129 A * 11/1924 Ruegg, Jr. ..... 139/93
1,802,907 A * 4/1931 Costello et al. ..... 139/96
1,972,296 A * 9/1934 Geier ..... 139/96
2,039,209 A * 4/1936 Blum ..... 139/368
2,047,511 A * 7/1936 Kaufmann ..... 139/92
2,522,043 A * 9/1950 Kaufmann ..... 139/92
2,552,487 A * 5/1951 Kaufmann ..... 139/96
2,690,771 A * 10/1954 Consoletti ..... 139/96
3,209,789 A * 10/1965 Munch ..... 139/93
3,417,789 A * 12/1968 Graf ..... 139/96
4,155,379 A * 5/1979 Graf ..... 139/93
4,156,379 A 5/1979 Studer
4,355,665 A * 10/1982 Ramseier et al. ..... 139/96

(Continued)

FOREIGN PATENT DOCUMENTS

CH 601532 7/1978

(Continued)

*Primary Examiner*—Gary L. Welch
*Assistant Examiner*—Robert H Muromoto, Jr.
(74) *Attorney, Agent, or Firm*—Fitch Even Tabin & Flannery; Norman Kunitz

(57) ABSTRACT

An improved heald consists of a flat material, such as tempered steel. It has closed (O-shaped) end eyelets (5, 6) which are one-piece parts of the heald body (4). An edge (10) which extends along the full length of the heald (1), is of entirely straight configuration. In contrast, the oppositely-located edge (11) consists of offset straight portions. A particularity of the heald according to the invention resides in the fact that the openings (15, 16) provided in the end eyelets (5, 6) for receiving the shaft staves are eccentrically arranged, whereby the two webs (17, 18) bordering the openings (15, 16) have unlike widths. With a reduced material input and weight a heald is obtained which, as concerns stability and possibility of utilization in existing weaving systems is at least equivalent to conventional healds.

16 Claims, 2 Drawing Sheets

U.S. PATENT DOCUMENTS

| | | | | | |
|---|---|---|---|---|---|
| 4,790,357 | A * | 12/1988 | Kramer | 139/91 |
| 5,152,325 | A * | 10/1992 | Koch | 139/91 |
| 5,176,183 | A * | 1/1993 | Koch | 139/93 |
| 5,699,836 | A * | 12/1997 | Golz | 139/22 |
| 6,105,623 | A * | 8/2000 | Tonz et al. | 139/93 |
| 6,176,270 | B1 * | 1/2001 | Mettler | 139/93 |
| 6,213,162 | B1 * | 4/2001 | Baechtold | 139/93 |
| 6,230,756 | B1 * | 5/2001 | Baumann et al. | 139/93 |
| 6,883,554 | B2 * | 4/2005 | Baumann et al. | 139/93 |
| 7,017,620 | B2 * | 3/2006 | Mettler et al. | 139/93 |
| 7,185,679 | B2 * | 3/2007 | Schwemmlein et al. | 139/93 |
| 7,204,274 | B2 * | 4/2007 | Mettler | 139/93 |
| 2005/0016613 | A1 * | 1/2005 | Mettler et al. | 139/93 |

FOREIGN PATENT DOCUMENTS

| | | |
|---|---|---|
| DE | 10342577 | 4/2005 |

* cited by examiner

HEALD, PARTICULARLY FOR RAPIDLY RUNNING WEAVING MACHINES

CROSS REFERENCE TO RELATED APPLICATION

This application claims the priority of German Patent Application No. 10 2005 033 175.0, filed on Jul. 13, 2005, the subject matter of which, in its entirety, is incorporated herein by reference.

BACKGROUND OF THE INVENTION

The invention relates to a heald having features as defined in the preamble of claim 1.

Healds designed for high-performance weaving machines are usually made of tempered steel for ensuring structural strength. The band width of the steel ribbon for manufacturing such healds has been worldwide standardized as being from 5.5 mm to 6 mm. Since the healds, because of the high operating speeds of the weaving machines, should be as light as possible despite the high specific mass of steel, in the length direction of the heald as large portions of the ribbon as possible are removed by punching and the thus-obtained edges are subsequently polished.

By punching out portions of the ribbon during the manufacturing process large quantities of waste are obtained which have to be disposed of. This circumstance increases the endeavor to reduce the quantity of raw material used in the manufacture of healds.

Swiss Patent No. 601 532 discloses healds made of wire or flat material having endwise appended end eyelets which are, for example, plastic.

Although by such a measure the quantity of raw material may be reduced, a critical connecting location between heald and end eyelet exists which may give rise to problems in rapidly operating weaving machines.

The same considerations apply to Swiss Patent No. 410 815 which describes healds made of flat steel or round steel and have appended end eyelets.

Further, in practice healds made of flat steel are known which have a straight edge extending from end eyelet to end eyelet and which have O-shaped end eyelets. As noted earlier, however, such healds too, have the disadvantage of large waste during manufacture.

It is therefore the object of the invention to provide an improved heald.

SUMMARY OF THE INVENTION

The above object is achieved with a heald as defined in claim 1:

The heald according to the invention has a one-piece, elongated heald body which has a yarn eyelet and is, at its end, provided with end eyelets. The heald thus consists, including the yarn eyelet and the end eyelets, of a single, preferably seamless part which may be made of a steel ribbon, for example, by a punching operation. At one side the heald body has a straight edge which extends from end eyelet to end eyelet and beyond and which defines the length direction of the healds. The width of the yarn eyelet and that of the end eyelets are measured transversely to such a direction. The width of the end eyelet is maximum twice the width of the yarn eyelet. Since the size, particularly the width of the yarn eyelet represents the weakest and mechanically the most stressed location of the heald, such width must not fall below a minimum magnitude. Insofar the invention is concerned with a heald for rapidly operating weaving machines, that is, healds which are adapted for high-speed weaving, the size of the yarn eyelet is not larger than 5.5 mm times 1.2 mm (inner dimension). Accordingly, the outer width of the yarn eyelet cannot fall below a minimum size. Thus, according to the invention, as noted earlier, the width of the end eyelets is limited, whereby waste from the punching operation is minimized, although the inner dimension of the end eyelets can also not be arbitrarily set; rather, it is predetermined by the width of the shaft staves. The inventor, however, has recognized that the outer sizes of the end eyelets may be reduced to the above-given dimension.

The above measures not only minimize waste, but also reduce the weight of the heald which makes possible a further increase in the weaving speed.

In case the yarn eyelet has at least the above-given inner width (5.5 mm in the length direction and 1.2 mm in the transverse direction), automatic threading machines for the yarn thread-in may be utilized.

It has been found expedient to provide that the width of the end eyelet is at least 1.8 times the width of the heald in the region of the yarn eyelet. This ensures more than a sufficient stability of the end eyelet. This applies particularly, if the end eyelet is a closed, approximately rectangular annulus. Such end eyelets are also referred to as O-shaped end eyelets. Such an end eyelet preferably has two mutually essentially parallel, longitudinal webs which are preferably entirely straight. One of the webs borders the straight edge (and constitutes a portion thereof), while the other web is arranged at the oppositely located side of the heald. The web bordering the straight edge is preferably wider than the web spaced from the straight edge. Such an arrangement has at least two advantages: First, the acceleration or braking forces and, in general, all forces introduced in this manner by the shaft stave into the heald are transmitted reliably and with only slight stresses on the heald. Further, a relatively large transverse offset is obtained between the yarn eyelet and a line interconnecting the end eyelets. This increases the distance of the yarn eyelets in heald arrangements having frequently desired dual yarn eyelet sets.

It has been found to be advantageous in this connection to provide that the web bordering the straight edge has a width which is at least 1.6 times greater than the width of the other web. The above-noted advantages are achieved in such a case to a particular degree.

While the edge situated on one side of the heald lies on a straight line, the oppositely located edge is preferably subdivided into portions which are straight by themselves, but which lie on lines parallel to one another. As a result, on the one hand, the heald weight is minimized and, on the other hand, a stabile heald of tensile resistance is obtained.

Preferably, between the yarn eyelet and the end eyelets the heald body has a portion whose width is less than the width of the yarn eyelet, whereby the heald weight may be further minimized.

The width of the heald body at the yarn eyelet is preferably at least 2.3 mm and at most 2.6 mm. These dimensions have been found to be expedient for most cases where very high weaving speeds are to be used.

Preferably, the heald body is twisted at its yarn eyelet. This then means that one part of the heald body surrounding the yarn eyelet is slightly turned out of the plane which the flat material defines at other parts of the heald body. This measure facilitates the yarn run.

The heald body is preferably made of tempered steel. If required, other flat materials may find application. The flat material may be provided with one or more undulations for maintaining adjoining healds at a distance from one another. The undulations give rise to a certain spring effect which may be advantageous.

It is feasible to provide in the heald body, preferably in the vicinity of the end eyelets, transport and/or separating openings which ensure a normal handling of the healds.

Further details of advantageous embodiments form subject of the drawing, the description and the claims.

The drawing shows an embodiment of the invention. The embodiment serves for illustration and although it comprises advantageous and inventive details, it is not to be regarded as limiting the scope of the invention.

DETAILED DESCRIPTION OF THE INVENTION

Figure 1:
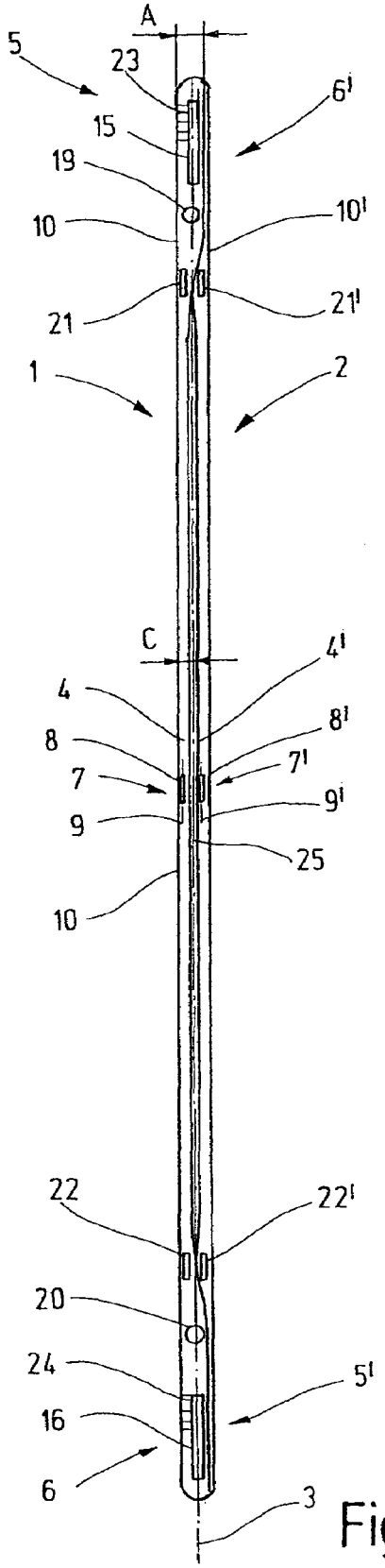
FIG. 1 is a simplified side elevational view of two healds according to the invention, having a dual yarn eyelet set.

FIG. 1 shows two healds 1, 2 of identical structure, superposed on one another in a position turned 180°. The healds 1, 2 are to be assembled in a heald shaft and, with the latter, serve for guiding the warp yarns and for shed-forming. In addition to the heald 1, further healds are stacked above one another parallel to the plane of the drawing in the same arrangement and are to a certain extent flush with the heald 1. Likewise, further identical and thus flush healds are associated with the heald 2. Preferably, the healds of the arrangement pertaining to the heald 1 alternate with the healds of the arrangement pertaining to the heald 2. The description of the heald 1 which follows applies equally and correspondingly to the heald 2 which in FIG. 1 is arranged in a mirror image to the heald 1, relative to a line of symmetry 3. The details of the heald 2 are provided in FIG. 1 with the same reference numerals as the details of the heald 1. They are provided with an apostrophe merely for graphic differentiation. The description of the heald 1 nevertheless applies to the heald 2.

The heald 1 has a long, narrow, strip-shaped heald body 4, on the ends of which end eyelets 5, 6 are formed. The latter are one-piece components of the heald body 4, that is, they are made of the same material as the heald body 4 and adjoin the latter in a seamless manner. The heald body 4 is, including its end eyelets 5, 6, made, for example, by punching from a flat steel ribbon.

Figure 3:
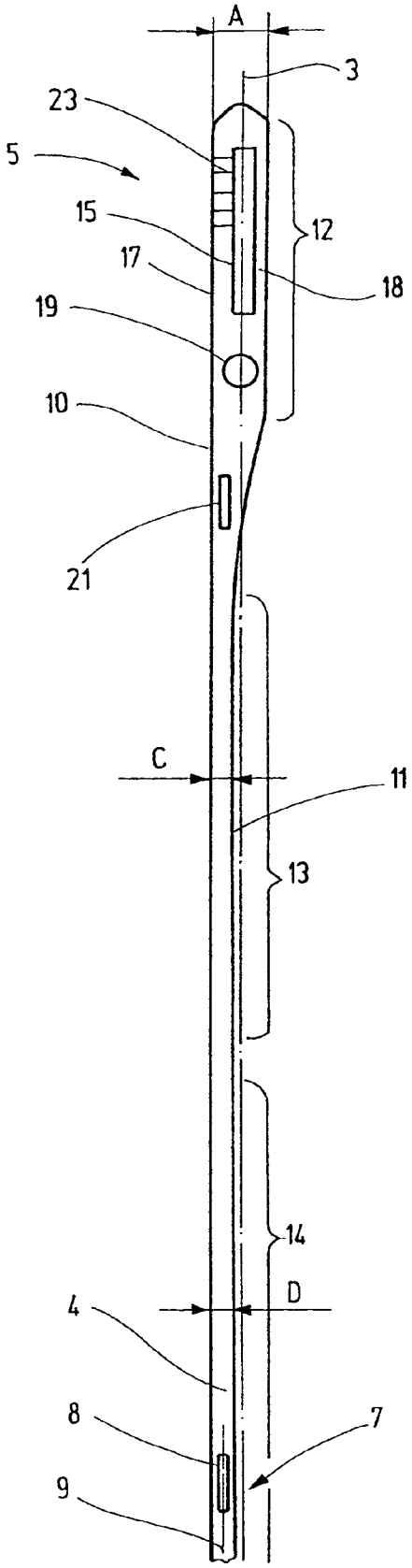
FIG. 3 is a fragmentary side elevational view of one of the healds according to FIG. 1, shown on a different scale.

The heald body 4 has a yarn eyelet 7 which is situated in a region between the end eyelets 5, 6 and which is constituted preferably by an elongated opening 8. The length direction 9 of the opening is oriented preferably in the length direction of the heald, that is, approximately parallel to the symmetry line 3. The heald body 4 has a straight edge 10 which extends from the end eyelet 5 to the end eyelet 6 and which merges at each end into a rounded or polygonal terminal edge. The straight edge 10 is oriented parallel to the symmetry line 3. The oppositely located edge 11, as seen particularly in FIG. 3, is, on each side of the yarn eyelet 7, subdivided into portions 12, 13, 14 which are straight by themselves and between which short, arcuate or straight transitional portions are provided. The portions 12, 13, 14 are oriented parallel to the symmetry line 3, but are offset parallel to one another. The portions 13, 14 situated externally of the end eyelet 5 (as well as the end eyelet 6) lie on the same side of the symmetry line 3 as the edge 10. Stated differently, the symmetry line 3 passes through the heald body 4 only at the end eyelets 5, 6, otherwise it is situated externally thereof. The symmetry line 3 passes centrally through the openings 15, 16 of the end eyelets 5, 6. The openings 15, 16 serve for receiving the shaft stave and are preferably approximately rectangular. Stated differently, the end eyelets 5, 6 and the yarn eyelet 7 are arranged on the heald body 4 in such a manner relative to one another that, in case two identical healds 1, 2 are provided with dual yarn eyelet sets as shown in FIG. 1, between the yarn eyelets 7, 7' a clearance 25 remains as viewed in a lateral direction. The view in the lateral direction is oriented perpendicularly to the plane of the drawing and thus perpendicularly to the healds.

Figure 2:
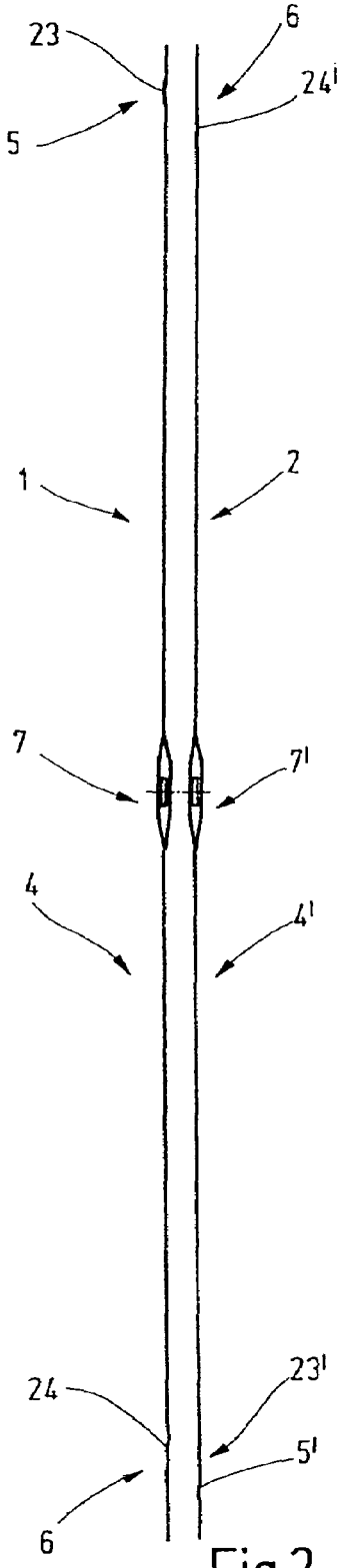
FIG. 2 is a front elevational view of the healds according to FIG. 1.

As it may be observed particularly also in FIG. 2, the heald body consists of a flat material, such as steel sheet metal. Its thickness visible in FIG. 2 is substantially less than the width of the heald body 4 between the end eyelets 5, 6. According to FIG. 3, the heald body 4 is the widest at its end eyelets measured transversely to the edge 10. Its width A (see at the top of FIG. 3) is 1.8 to 2 times greater than the width D in the region of the yarn eyelet 7, measured in the same direction, that is, measured inside the portion 14 of the edge 11 (see FIG. 3). The width C of the heald body 4 in the portion 13 measured in the same direction is even smaller.

As it may be particularly well seen in FIG. 3, the essentially rectangular opening 15 of the end eyelet 5 is bordered by two webs 17, 18 which are oriented parallel to the straight edge 10 and in the length direction thereof, that is, in the direction of the straight edge 10. The two, individually straight webs 17, 18 form part of the heald body 4, that is, they are one-piece parts thereof. They are each bordered in a parallel-flanked manner, that is, they have a uniform width along their entire length, measured in the direction of the symmetry axis 3. The web 17 joins the straight edge 10 and defines a portion thereof. The oppositely located web 18 forms a part of the portion 12 of the edge 11. The webs 17, 18 are at both ends (at the top and the bottom in the Figures) connected with the rest of the heald body and thus connected with one another. The web 18 is narrower than the web 17. The same applies to the end eyelet 6. By virtue of such an arrangement, the symmetry line 3 extends parallel to the straight edge 10. The offset between the straight edge 10 and the symmetry line 3 (or also between a line passing through the yarn eyelet 7 parallel to the straight edge 10 and the symmetry line 3) is, because of the unlike web widths of the webs 17, 18, greater than it would be in case of equally wide webs. Consequently, as seen in FIG. 1, the distance between the length directions 9, 9' of the two yarn eyelets 7, 7' of the adjoining healds 1, 2 is greater than it would be in case of symmetrical end eyelets 5, 6.

In the region of the end eyelets 5, 6 transport openings 19, 20 are provided which are, for example, circular apertures. They are arranged preferably centrally with respect to the symmetry line 3 and serve to convey the healds 1, 2 in bundles. The transport openings 19, 20 of the healds 1, 2 are thus in alignment with one another.

Further, the heald 1 preferably has separating openings 21, 22, by means of which the healds in the position of heald 1 and the healds in the position of heald 2 may be respectively separately received.

A further optional, but expedient feature are undulations 23, 24 formed on the end eyelets 5, 6, as shown in FIG. 2.

The undulations 23, 24 are preferably eccentrically located with respect to the respective end eyelets 5, 6, so that, as illustrated in FIG. 2, adjoining healds 1, 2 are supported on each other at different locations. Further, in their central region the healds are twisted about the respective yarn eyelet 7, that is, in that location the flat material is turned out of its plane to orient the yarn eyelet 7 slightly in the warp yarn direction.

The heald according to the invention may be made from a flat material by a punching operation. The required width of the steel ribbon corresponds to the width of the end eyelet 5 (and 6, respectively). Such a width is composed of the width of the web 17, the width of the web 18 and the required width of the opening 15 situated therebetween. By virtue of the unlike dimension of the widths of the webs 17, 18, particularly the reduction of the width of the web 18, a total width A for the yarn eyelet 5 (and also 6) is obtained which is less than in conventional healds. Nevertheless, the usual distance between the symmetry line 3 and the opening 8 of the yarn eyelet 7 is obtained. In this manner, by using a reduced material quantity, a lighter and thus a more rapid heald may be provided which is adapted for use in existing heald shafts and weaving systems.

An improved heald consists of a flat material, such as tempered steel. It has closed (O-shaped) end eyelets 5, 6 which are one-piece parts of the heald body 4. An edge 10 which extends along the full length of the heald 1, is of entirely straight configuration. In contrast, the oppositely-located edge 11 consists of offset straight portions. A particularity of the heald according to the invention resides in the fact that the openings 15, 16 provided in the end eyelets 5, 6 for receiving the shaft staves are eccentrically arranged, whereby the two webs 17, 18 bordering the openings 15, 16 have unlike widths. With a reduced material input and weight a heald is obtained which, as concerns stability and possibility of utilization in existing weaving systems is at least equivalent to conventional healds.

It will be appreciated that the above description of the present invention is susceptible to various medications, changes and adaptations, and the same are intended to be comprehended within the meaning and range of equivalents of the appended claims.

List of Reference Characters:

1, 2 healds
3 symmetry line
4 heald body
5, 6 end eyelets
7 yarn eyelet
8 opening
9 length direction of the opening
10 straight edge
11 edge
12, 13, 14 portions
15, 16 openings
17, 18 webs
19, 20 transport openings
21, 22 separating openings
23, 24 undulations
A, C, D width

The invention claimed is:

1. A heald (1), particularly for rapidly operating weaving machines, comprising an elongated, one-piece heald body (4) which is provided with a yarn eyelet (7) and which, at its ends, is provided with end eyelets (5, 6), wherein the heald body (4) has, at one side, a straight edge (10) which extends along the entire length of the heald body (4) and beyond both end eyelets (5, 6), and wherein the heald body (4) has, at the end eyelets (5, 6) and at the yarn eyelet (7), a respective width (A, D) measured transversely to the straight edge (10), characterized in that the width (A) of the heald body (4) is, at least at one of the end eyelets (5), at most twice the width (D) at the yarn eyelet (7).

2. The heald as defined in claim 1, characterized in that the width (A) of the end eyelet (5) is at least 1.8 times the width (D) of the yarn eyelet (7).

3. The heald as defined in claim 1, characterized in that at least one of the end eyelets (5) is a closed, approximately rectangular annulus which has two elongated webs (17, 18) extending parallel to the straight edge (10).

4. The heald as defined in claim 3, characterized in that the webs (17, 18) have unlike widths measured transversely to the straight edge (10).

5. The heald as defined in claim 4, characterized in that one of the webs (17, 18) borders the straight edge (10) and that such web (17) has a greater width than the other web (18) which does not border the straight edge (10).

6. The heald as defined in claim 5, characterized in that the web (17) bordering the straight edge (10) has a width which is at least 1.6 times greater than the width of the other web (18).

7. The heald as defined in claim 4, characterized in that the edge (11) situated opposite the straight edge (10) has straight portions (12, 13, 14) which are oriented parallel to one another.

8. The heald as defined in claim 1, characterized in that the heald body (8) has, in at least one portion (13) between the end eyelets (5, 6) and the yarn eyelet (7), a width which is less than the width of the yarn eyelet (7).

9. The heald as defined in claim 1, characterized in that the width (D) of the heald body (4) at the yarn eyelet (7) is at least 2.3 mm.

10. The heald as defined in claim 1, characterized in that the width of the heald body (4) at the yarn eyelet (7) is at most 2.6 mm.

11. The heald as defined in claim 1, characterized in that the heald body (4) is twisted at its yarn eyelet (7).

12. The heald as defined in claim 1, characterized in that the heald body (4) is made of a flat material.

13. The heald as defined in claim 12, characterized in that at least one undulation (23) is provided in the flat material.

14. The heald as defined in claim 1, characterized in that in the heald body (4), in the vicinity of the end eyelets (5, 6), transport openings (19, 20) are provided which are centered with respect to the end eyelets (5, 6).

15. The heald as defined in claim 1, characterized in that in the heald body (4), in the vicinity of the end eyelets (5, 6), separating openings (21, 22) are provided which are eccentric with respect to the end eyelets (5, 6).

16. The heald as defined in claim 1, characterized in that the end eyelets (5, 6) and the yarn eyelet (7) are arranged on the heald body (4) in such a manner with respect to one another that, in case of two identical healds (1, 2) having a dual yarn eyelet set (FIG. 1), between the yarn eyelets (7, 7') a clearance (25) is obtained as viewed laterally (FIG. 1).

* * * * *